US006135170A

United States Patent [19]

Lee et al.

[11] Patent Number: 6,135,170

[45] Date of Patent: Oct. 24, 2000

[54] FILLING CONTAINERS WITH GAS

[75] Inventors: Robert Michael Lee, Aldershot; Graham Sydney Lawrence, High Wycombe, both of United Kingdom

[73] Assignee: The BOC Group plc, Windlesham, United Kingdom

[21] Appl. No.: 09/442,974

[22] Filed: Nov. 18, 1999

[30] Foreign Application Priority Data

Nov. 25, 1998 [GB] United Kingdom ..... 9825763

[51] Int. Cl.[7] ..... B67C 3/00

[52] U.S. Cl. ..... 141/196; 141/197; 141/39

[58] Field of Search ..... 141/3, 20, 39, 141/44, 47, 51, 67, 192, 196, 197

[56] References Cited

U.S. PATENT DOCUMENTS

| | | | |
|---|---|---|---|
| 3,593,735 | 7/1971 | Reiher | 137/88 |
| 5,351,726 | 10/1994 | Diggins | 141/197 |
| 5,409,046 | 4/1995 | Swenson et al. | 141/197 |
| 5,427,160 | 6/1995 | Carson et al. | 141/39 |
| 5,454,408 | 10/1995 | DiBella et al. | 141/197 |
| 5,586,587 | 12/1996 | Leininger et al. | 141/196 |
| 5,901,758 | 5/1999 | Hwang et al. | 141/197 |
| 5,992,478 | 11/1999 | Micke et al. | 141/196 |

FOREIGN PATENT DOCUMENTS

WO 94/24263 10/1994 WIPO .

*Primary Examiner*—Steven O. Douglas
*Assistant Examiner*—Khoa D. Huynh
*Attorney, Agent, or Firm*—Philip H. Von Neida; Salvatore P. Pace

[57] ABSTRACT

Methods and apparatus for filling containers with a gas or gas mixture under pressure are disclosed. The apparatus comprises a fixed volume vessel for containing the gas at a pressure $P_1$, a line extending from the fixed volume vessel to a buffer volume vessel which has a capacity greater than the volume of the container to be filled, a pressure controller for controlling the pressure of the gas in the line so that the gas reaches the buffer volume vessel at a pressure $P_2$ which is less than $P_1$, a further line extending from the buffer volume vessel to at least one filling nozzle, and a valve located in the further line for controlling the flow of gas from the buffer volume vessel to the gas capsule to be filled.

2 Claims, 1 Drawing Sheet

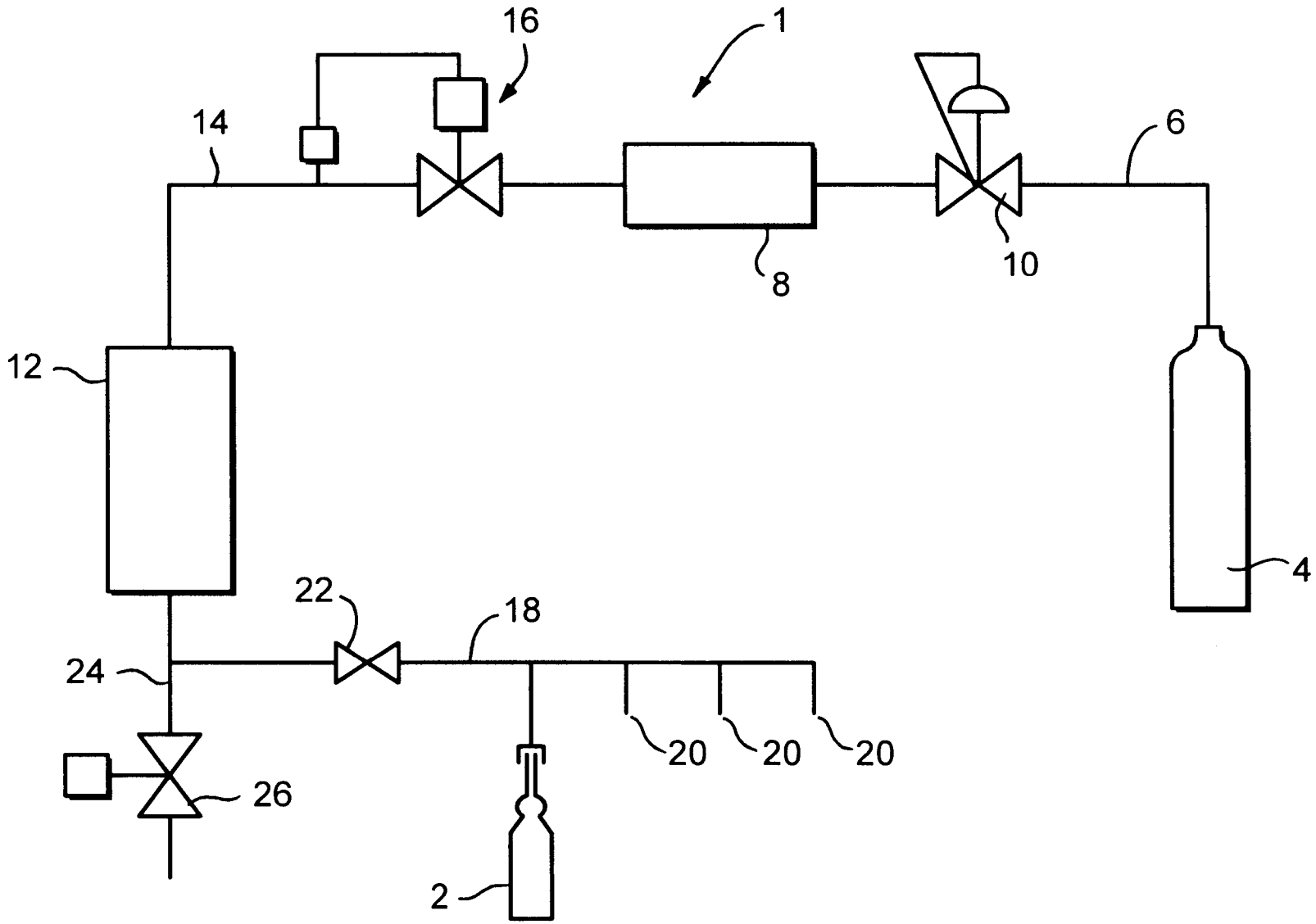
1
2
4
6
8
10
12
14
16
18
20
20
20
22
24
26

FILLING CONTAINERS WITH GAS

The present invention relates to methods of and apparatus for filling containers with a gas or a mixture of gases under pressure.

For the avoidance of doubt, throughout this specification the term "gas" is intended not only to embrace a single gas but also a mixture of gases.

Gases have many applications throughout industry and in healthcare. Where very large quantities of gases are required, for example, oxygen in the manufacture of steel, the oxygen can be supplied directly from an air separation unit along dedicated pipe work to a furnace. However, in very many applications gases are delivered to an end user in cylinders. For example, medical gas is often delivered in cylinders to hospitals, pharmacies or the domicile of an end user.

Welding gas mixtures are invariably transported in special gas cylinders between a first location at which the cylinders are filled with the various constituents of the gas mixture and a location at which the welding operation is to take place.

According to the type of gas and its application, the cylinder material and its construction and design, the pressure of gas in the cylinder will vary accordingly.

In some applications, for example, the needleless injection of drugs through the skin of a patient as described in PCT Published Application WO94/24263, the propelling force is provided by helium which is held in a gas capsule at high pressures for example up to 80 barg. It is important in such a medical application that the pressure of the helium is known to very close tolerances. Further, when many thousands if not millions of gas capsules are filled it is important commercially for the filling operation to be reduced in time to an absolute minimum.

It is the aim of the present invention to provide an apparatus for and a method of improving the accuracy and repeatability of the pressure of the gas within a container and also to reduce the time taken to complete the filling operation. According to one aspect of the present invention, an apparatus for filling at least one container with a gas at a pre-selected pressure comprises a fixed volume vessel for containing the gas at a pressure $P_1$ a line extending from the fixed volume vessel to a buffer volume vessel, a pressure controller for monitoring and controlling the pressure of gas in said line so that said gas reaches the buffer volume vessel at a pressure $P_2$ where $P_2$ is less than $P_1$, a further line extending from the buffer volume vessel to at least one filling nozzle, a valve located in the further line for controlling the flow of gas from the buffer volume vessel to the or each gas capsule to be filled, and wherein the buffer volume vessel has a capacity which is greater than the volume or the sum of the volumes of the containers to be filled.

In a preferred embodiment, a mass flow controller is provided downstream of the pressure controller to effect a constant leak which matches the minimum turndown of the pressure controller. This ensures that the pressure controller never closes completely or enters its deadband.

According to a further aspect of the present invention, a method of filling at least one container with a gas at a pre-selected pressure comprises the steps of initially holding the gas at a pressure $P_1$ in a fixed volume vessel; monitoring and controlling the flow of the gas from the fixed volume vessel to a buffer volume vessel such that the pressure of the gas in the buffer volume vessel is $P_2$; and passing the gas at the pressure $P_2$ from the buffer volume vessel towards at least one nozzle for filling the container(s).

In one embodiment, the container is a gas capsule of 5 ml capacity and the gas is helium.

An embodiment of the invention will now be described, by way of example, reference being made to the FIGURE of the accompanying diagrammatic drawing which FIGURE is a block representation of an apparatus for filling at least one container with a gas under pressure.

As shown, an apparatus 1 for filling one or more containers 2 with a gas under pressure includes a source of the gas in the form of a pressure vessel 4, the gas being held in the vessel 4 at a pressure of $P_0$. A line 6 extends from the pressure vessel 4 to a fixed volume vessel 8. A pressure regulator 10 is located in the line 6 between the pressure vessel 4 and the fixed volume vessel 8.

Extending between the fixed volume vessel 8 and a buffer volume vessel 12 is a second line 14 and located within the line 14 is a pressure controller 16.

A third line 18 extends from the buffer volume vessel 12 towards one or more filling nozzles 20. Located within the third line 18 is a valve 22.

A fourth line 24 extends from the third line 18 at a location between the buffer volume vessel 12 and the valve 22 and located in said fourth line 24 is a thermal mass flow controller 26.

In use, the pressure regulator 10 is set to deliver gas along the line 6 from the pressure vessel 4 to the fixed volume vessel 8 such that the gas reaching the fixed volume vessel 8 is at a pressure $P_1$ where $P_1$ is less than $P_0$.

The pressure controller 16 monitors the pressure of gas in the second line 14 and using a feedback control adjusts the pressure of gas flowing along the line 14 and into the buffer volume vessel 12. In effect, the pressure controller 16 turns down the closer it gets to its set pressure reading. This results in the final pressure with the buffer volume vessel 12 being held accurately to a pressure $P_2$ where $P_2$ is less than $P_1$.

When the or each container 2 is aligned with a respective nozzle 20 the valve 22 is opened and gas held in the buffer volume vessel 12 passes almost instantaneously through the line 18 to fill the container(s) 2.

It is an essential feature that the buffer volume vessel 12 has a greater capacity than the sum of the volumes of the containers 2 to be filled.

The accuracy of the pressure controller 16 is maintained by ensuring that it never closes completely. This is achieved by allowing a minute leak from the buffer volume vessel 12 via the thermal mass flow controller 26 which matches the minimum turndown of the pressure controller 16. This arrangement ensures that the pressure controller 16 never enters its dead band.

By way of example, when it is required to fill containers 2 in the form of gas capsules for use in medical applications, for example, the needleless injection of drugs through the skin of a patient, the gas capsules each having a volume of 5 ml are filled with helium gas to a pressure of 40 barg.

The pressure vessel 4 is provided with helium gas at a pressure of approximately 100 barg. The pressure regulator 10 is set to allow the helium to fill the fixed volume vessel 8 of 1 liter capacity with helium at a pressure of 80 barg. The pressure controller 16 then feeds the helium to the buffer volume vessel 12 at a pressure of 45 barg and the mass flow controller 26 is set to give a constant 50 cc per minute leak. With this set up a gas capsule can be filled in 0.15 seconds with helium at a pressure of 40 barg plus or minus 0.35%.

In a modification the fixed volume vessel 8 need not be a vessel as such but could be an enlarged pipe portion inserted between the lines 6, 14. It will be apparent that in the embodiment described above and in particularly the example, the gas capsules/ containers 2 can be filled at very high speeds with a gas such as helium to a pressure the accuracy of which is within very close tolerances.

Clearly the apparatus and method described is suitable for filling gas cylinders of substantially any volume at any given pressure with speed and high accuracy.

Having thus described the invention, what we claim is:

1. An apparatus for filling at least one container with a gas at a pre-selected pressure comprising a fixed volume vessel for containing the gas at a pressure $P_1$, a line extending from the fixed volume vessel to a buffer volume vessel, a pressure controller for monitoring and controlling the pressure of gas in said line so that said gas reaches the buffer volume vessel at a pressure $P_2$ where $P_2$ is less than $P_1$, a further line extending from the buffer volume vessel to at least one filling nozzle, a mass flow controller located downstream of said pressure controller, thereby effecting a constant leak which matches the minimum downturn of said pressure controller, a valve located in the further line for controlling the flow of gas from the buffer volume vessel to the or each gas capsule to be filled, and wherein the buffer volume vessel has a capacity which is greater than the volume or the sum of the volumes of the containers to be filled.

2. A method of filling a gas capsule having a capacity of 5 ml with helium at a pre-selected pressure comprising the steps of passing said helium from a source held at a pressure of 100 bar to a fixed volume vessel held at a pressure of 80 bar; holding the helium in said fixed volume vessel; monitoring and controlling the flow of the helium from the fixed volume vessel to a buffer volume vessel such that the pressure of the helium in the buffer volume vessel is 45 bar; and passing the gas at the pressure of 45 bar from the buffer volume vessel to at least one nozzle for filling the gas capsule.

* * * * *